US005776248A

United States Patent [19]

Spatafora

[11] Patent Number: 5,776,248

[45] Date of Patent: Jul. 7, 1998

[54] GUMMING DEVICE

[75] Inventor: Mario Spatafora, Bologna, Italy

[73] Assignee: Azionaria Costruzioni Macchine Automatiche A.C.M.A. S.p.A., Bologna, Italy

[21] Appl. No.: 709,219

[22] Filed: Sep. 6, 1996

[30] Foreign Application Priority Data

Sep. 7, 1995 [IT] Italy ..... BO95A0416

[51] Int. Cl.[6] ..... B05C 1/00; B05C 1/08

[52] U.S. Cl. ..... 118/202; 156/498; 156/578; 165/89; 492/46

[58] Field of Search ..... 118/202; 156/498, 156/578; 165/89; 492/17, 30, 46

[56] References Cited

U.S. PATENT DOCUMENTS

| | | | |
|---|---|---|---|
| 3,406,748 | 10/1968 | Jarreby | 165/89 |
| 4,235,002 | 11/1980 | Pav et al. | 165/89 X |
| 4,964,202 | 10/1990 | Pav et al. | 492/46 X |
| 5,078,204 | 1/1992 | Loffredo et al. | 165/89 |
| 5,209,283 | 5/1993 | Miltzow et al. | 492/46 X |
| 5,279,535 | 1/1994 | Hawes et al. | 492/46 |
| 5,285,844 | 2/1994 | Schneid | 156/89 |
| 5,292,298 | 3/1994 | Scannell | 492/46 |

FOREIGN PATENT DOCUMENTS

| | | | |
|---|---|---|---|
| 687737 | 6/1964 | Canada | 118/202 |
| 2170576 | 8/1986 | United Kingdom | 165/89 |
| 019874 | 10/1993 | WIPO | 492/46 |

OTHER PUBLICATIONS

Patent Abstracts of Japan, vol. 7, No. 131 (C-169), Jun. 8, 1983, JP-A-58 045768, Mar. 17, 1983.

Patent Abstracts of Japan, vol. 16, No. 213 (C-0942), May 20, 1992, JP-A-04 040254, Feb. 10, 1992.

*Primary Examiner*—David A. Simmons
*Assistant Examiner*—Paul M. Rivard
*Attorney, Agent, or Firm*—Oblon, Spivak, McClelland, Maier & Neustadt, P.C.

[57] ABSTRACT

A gumming device includes a frame and a gumming roller fitted in a rotary manner to the frame. The device includes a circuit circulating a cooling fluid, the circuit including a first and second portion, the first portion extending through the roller and having two opposite ends, at least one of which is connected to the second portion. The device also includes a seal connecting the two portions of the circuit in a rotary and fluidtight manner, the gumming roller being removably connected to the second portion and including a normally-closed valve controlling the opposite ends of the first portion. The frame includes a shoulder cooperating with and maintaining the valve in an open position when the gumming roller is fitted to the frame.

4 Claims, 2 Drawing Sheets

GUMMING DEVICE

BACKGROUND OF THE INVENTION

1. Field of the Invention

The present invention relates to a gumming device.

More specifically, the present invention relates to a gumming device of the type comprising a frame, and a gumming roller fitted to the frame and rotating about its own longitudinal axis.

2. Discussion of the Art

The gumming roller of devices of the above type normally rotates at relatively high speed in contact with one or more scraper elements for removing any surplus gum from the outer surface of the roller. The friction between the outer surface of the gumming roller and the scraper elements therefore inevitably results in heating of the roller, which, operating at relatively high temperature, may cause the film of gum on its outer surface to dry rapidly, thus resulting in high-cost cleaning and servicing operations whenever the machine fitted with the gumming device is arrested, even relatively briefly.

SUMMARY OF THE INVENTION

It is an object of the present invention to provide a gumming device designed to overcome the aforementioned drawback.

According to the present invention, there is provided a gumming device comprising a frame and a gumming roller fitted in rotary manner to the frame; characterized by also comprising a circuit for circulating a cooling fluid; the circuit comprising a first and second portion; the first portion extending through said roller and presenting two opposite ends, at least one of which is connected to the second portion; and sealing means being provided for connecting said two portions of the circuit in rotary and fluidtight manner.

To simplify washing and maintenance of the gumming roller and, at the same time, prevent the portion of the cooling circuit extending through the gumming roller from being damaged when the roller is washed, the gumming roller of the above gumming device is preferably connected removably to said second portion of the circuit; the gumming roller presenting valve means for controlling said ends of said first portion of the circuit.

Preferably, said valve means are normally-closed valve means; the frame presenting shoulder means cooperating with and for maintaining said valve means in an open position when the gumming roller is fitted to the frame.

BRIEF DESCRIPTION OF THE DRAWINGS

A non-limiting embodiment of the present invention will be described by way of example with reference to the accompanying drawings, in which.

DESCRIPTION OF THE PREFERRED EMBODIMENTS

Figures 1, 3, 4, 5, 6, 7:
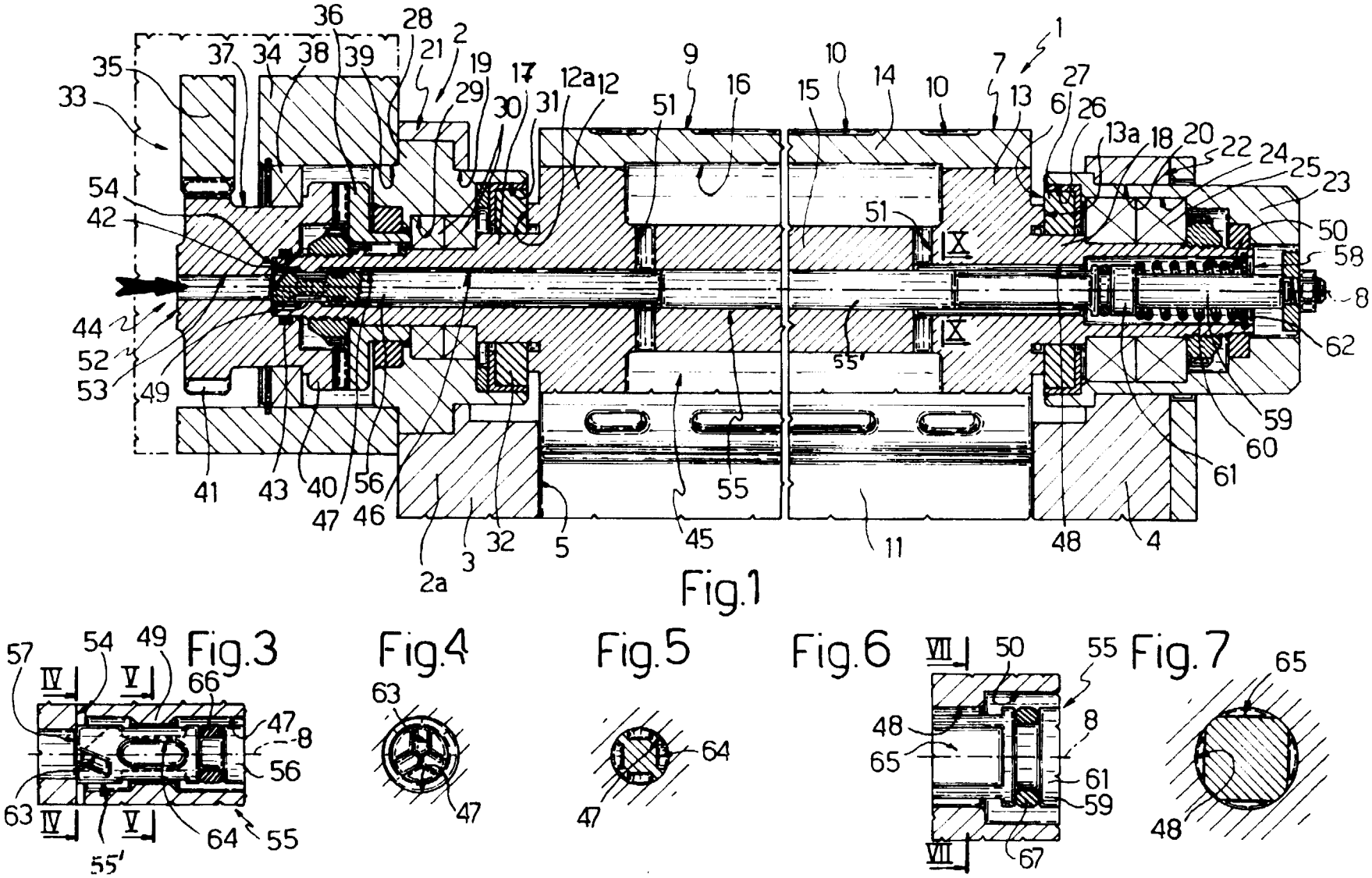
FIG. 1 shows a schematic axial section of a gumming device in accordance with the teachings of the present invention and in a first operating position.
FIG. 3 shows a larger-scale view of a first detail in FIG. 1.
FIGS. 4 and 5 show sections taken along lines IV—IV and V—V, respectively, in FIG. 3.
FIG. 6 shows a larger-scale view of a second detail in FIG. 1.
FIG. 7 shows a section taken along line VII—VII in FIG. 6.

Number 1 in FIG. 1 indicates a gumming device comprising a frame 2 in turn comprising a cup-shaped casing 2*a* presenting two vertical lateral walls 3 and 4 defining a chamber 5, a bottom portion (not shown) of which defines a tank (not shown) for an adhesive substance (not shown), and a top portion 6 of which houses a cylindrical gumming roller 7.

Roller 7 forms part of device 1, is fitted to casing 2*a* to rotate about its own longitudinal axis 8, and presents a substantially cylindrical outer surface 9 coaxial with axis 8, and which receives said adhesive substance from a known supply device (not shown). More specifically, surface 9 presents a number of cavities 10, each for retaining and then transferring a respective portion of said adhesive substance onto a respective portion of a sheet (not shown) of material to be gummed.

Device 1 also comprises a scraper element 11 housed inside casing 2*a* and located beneath roller 7 and substantially contacting surface 9 of roller 7, so as to remove all of said adhesive substance from surface 9 and to even the thickness of said adhesive substance retained, in use, inside cavities 10.

Roller 7 comprises two lateral walls 12 and 13 crosswise to axis 8; a cylindrical jacket 14 supported between walls 12 and 13 and defined externally by surface 9; and a central tubular body 15 integral with and located between walls 12 and 13, coaxially with axis 8, and defining a cylindrical annular chamber 16 together with jacket 14 and walls 12 and 13. Roller 7 also comprises two tubular end appendixes 17 and 18 extending coaxially with axis 8 from respective walls 12 and 13, and supported in rotary manner, inside respective through holes 19 and 29 formed in respective walls 3 and 4, by respective supports 21 and 22.

Support 22 comprises a tubular bell 23 fixed inside hole 20 and about appendix 18, and presenting a cavity 24 coaxial with axis 8, facing wall 13, and housing a pair of bearings 25 for supporting appendix 18. At the free end facing wall 13, bell 23 also presents an annular cavity 26 housing a sealing ring 27 contacting the outer surface 13*a* of wall 13. Support 21 comprises a bush 28 fixed inside hole 19 and about appendix 17, and presenting a through hole 29 coaxial with axis 8 and housing a pair of bearings 30 for supporting appendix 17. On the side facing wall 12, bush 28 also presents an annular cavity 31 housing a sealing ring 32 contacting the outer surface 12*a* of wall 12.

Device 1 also comprises a drive assembly 33 fitted to a fixed portion 34 of frame 2, to which cup-shaped casing 2*a* is connected removably so that device 1, and more specifically surface 9 of gumming roller 7, may be cleaned. Assembly 33 comprises a drive gear 35; a face gear 36 fitted to tubular appendix 17; and shoulder means defined by a bush 37 fitted in rotary manner, via the interposition of a bearing 38, inside a through hole 39 formed coaxially with axis 8 through portion 34. The end of bush 37 facing roller 7 comprises a face gear 40 coaxial with axis 8 and meshing, in use, with gear 36; the opposite end of bush 37 comprises a further gear 41 meshing with gear 35; and bush 37 also presents a cylindrical cavity 42 housing appendix 17 in a fluidtight manner via the interposition of a sealing ring 43 housed in the lateral wall of cavity 42.

Device 1 also comprises a circuit 44 for circulating a cooling fluid for cooling gumming roller 7, and comprising an inner portion 45 extending inside roller 7. In addition to chamber 16 of roller 7, inner portion 45 also comprises a longitudinal conduit 46 extending coaxially with axis 8 through tubular body 15 and through appendixes 17 and 18, which respectively define an inlet portion 47 and an outlet portion 48 of conduit 46. Portion 47 presents an annular projection 49 located in a substantially intermediate position along portion 47, and which narrows the section of conduit 46; and portion 48 communicates with a cavity 50 formed coaxially with axis 8 inside appendix 18, and presenting a section substantially larger than that of conduit 46.

Circuit 44 also comprises a number of radial conduits 51 formed through body 15 and for connecting conduit 46 and chamber 16; and an outer portion 52 partly defined by an axial conduit 53, which is formed through bush 37, is defined, at the end facing roller 7, by the end surface 54 of cavity 42, and communicates, at the opposite end, with a known external source (not shown) of said cooling fluid.

Figure 2:
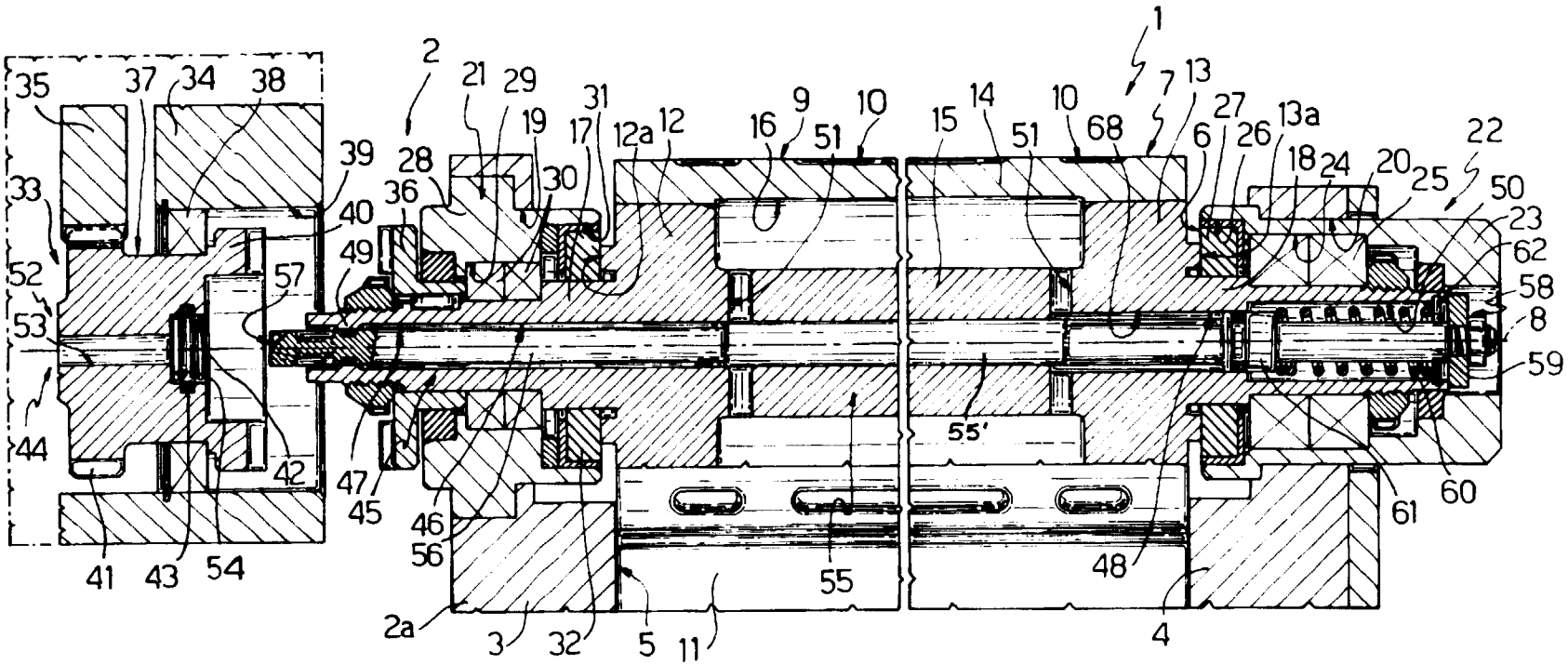
FIG. 2 shows a section of the FIG. 1 gumming device in a second position.
Figure 10:
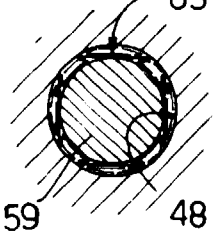
FIG. 10 shows a section along line X—X in FIG. 1.
Figure 9:
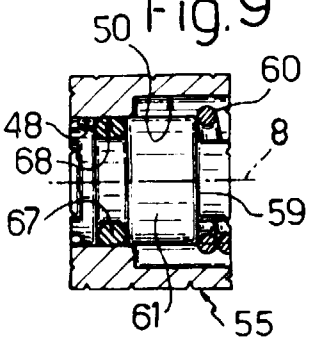
FIGS. 8 and 9 show larger-scale views of respective details in FIG. 2.
Figure 8:
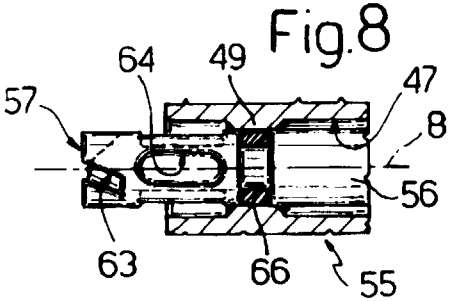

Device 1 also comprises valve means comprising a slide valve 55, which is movable along conduit 46 between a closed position closing portion 45 of circuit 44 (FIG. 2), and an open position opening portion 45 (FIG. 1). More specifically, valve 55 is defined by a rod 55', which presents one end 56 engaging portion 47 of conduit 46 and presenting an outer surface 57 crosswise to axis 8 and cooperating with the end surface 54 of cavity 42 to move valve 55 into the open position, in opposition to an elastic thrust device 58, when cup-shaped casing 2*a* is connected, in use, to fixed portion 34 of frame 2. The opposite end 59 of rod 55' engages portion 48 of conduit 46, and supports elastic device 58, which is defined by a helical spring 60 wound about end 59 and compressed between a projection 61 of rod 55' and a stop ring 62 fitted to a free end of cavity 50.

As shown in FIGS. 3 to 10, rod 55' presents a number of radial notches 63 (FIG. 3) inclined in relation to axis 8; a number of slots 64 (FIG. 5) equally spaced about axis 8; and a number of flat portions 65 (FIGS. 6 and 7) equally spaced about axis 8, for enabling the passage of said cooling fluid along conduit 46 when valve 55, in use, is set to the open position. Valve 55 also presents a sealing ring 66 fitted to valve 55 itself, at end 56, and cooperating with projection 49 to close inlet portion 47 and prevent the inflow of cooling fluid into portion 45 when valve 55, in use, is set to the closed position; and a sealing ring 67 fitted to valve 55, adjacent to and on the opposite side of projection 61 to spring 60, and cooperating with an inner surface 68 of portion 48 to completely isolate inner portion 45 of circuit 44 when cup-shaped casing 2*a* is disconnected, in use, from fixed portion 34 of frame 2 and valve 55 is pushed by spring 60 into the closed position.

In actual use, at the end of each operating phase, cup-shaped casing 2*a* is disconnected from fixed portion 34 of frame 2, and elastic device 58 pushes valve 55 into the closed position in which seal 66 contacts projection 49 (FIG. 3), and seal 67 contacts surface 68 (FIG. 9) of conduit 46, thus isolating portion 45 of circuit 44 completely from the outside and preventing the inflow of wash fluid inside portion 45.

When cup-shaped casing 2*a* is reconnected to fixed portion 34 of frame 2, end surface 54 of cavity 42 contacts surface 57 of end 56 of rod 55', and valve 55 is pushed by bush 37, in opposition to elastic device 58, into the open position in which slots 64 are located at projection 49, and seal 67 is located inside cavity 50 of tubular appendix 18, thus freeing conduit 46 and permitting the passage of cooling fluid through portion 45.

Obviously, additional modifications and variations of the present invention are possible in light of the above teachings. It is therefore to be understood that within the scope of the appended claims, the invention may be practiced otherwise than as specifically described herein.

I claim:

1. A gumming device comprising;

a frame and a gumming roller fitted in rotary manner to the frame;

a circuit circulating a cooling fluid, the circuit comprising a first and second portion, the circuit comprising a first and second portion, the first portion extending through said roller and having two opposite ends, at least one of which is connected to the second; and a seal connecting said two portions of the circuit in a rotary and fluidtight manner; the gumming roller being removably connected to said second portion and comprising a normally-closed valve controlling said opposite ends of said first portion: and the frame comprising a shoulder cooperating with and maintaining said valve in an open position when the gumming roller is fitted to the frame.

2. A gumming device as claimed in claim 1, wherein said valve comprises a slide valve.

3. A gumming device as claimed in claim 2, wherein said slide valve comprises a single slide valve; said first portion of the circuit comprising a conduit extending longitudinally through the gumming roller and between said two ends; and said slide valve being mounted so as to slide axially along said conduit and to and from a position closing said two ends.

4. A gumming device as claimed in claim 3, wherein elastic thrust members are interposed between said gumming roller and said slide valve to push the slide valve axially into said closed position.

* * * * *